US009420845B2

(12) United States Patent
Hsiao

(10) Patent No.: US 9,420,845 B2
(45) Date of Patent: Aug. 23, 2016

(54) SHOE UPPER STRUCTURE

(76) Inventor: Cheng-Tung Hsiao, Tianzhong Township, Changhua County (TW)

( * ) Notice: Subject to any disclaimer, the term of this patent is extended or adjusted under 35 U.S.C. 154(b) by 416 days.

(21) Appl. No.: 13/337,338

(22) Filed: Dec. 27, 2011

(65) Prior Publication Data

US 2013/0160323 A1 Jun. 27, 2013

(51) Int. Cl.

| | |
|---|---|
| ***A43B 1/04*** | (2006.01) |
| ***A43B 3/24*** | (2006.01) |
| ***A43B 23/04*** | (2006.01) |
| ***A43B 23/02*** | (2006.01) |

(52) U.S. Cl.

CPC . *A43B 3/248* (2013.01); *A43B 1/04* (2013.01); *A43B 23/027* (2013.01); *A43B 23/0235* (2013.01); *A43B 23/042* (2013.01)

(58) Field of Classification Search

CPC ..... A43B 1/04; A43B 23/02; A43B 23/0245; A43B 23/042; A43B 3/248

USPC ..... 36/9 R, 45, 47, 48, 49

See application file for complete search history.

(56) References Cited

U.S. PATENT DOCUMENTS

| | | | | |
|---|---|---|---|---|
| 6,931,762 | B1 * | 8/2005 | Dua | 36/9 R |
| 7,051,460 | B2 * | 5/2006 | Orei et al. | 36/84 |
| 7,131,296 | B2 * | 11/2006 | Dua et al. | 66/178 R |
| 7,774,956 | B2 * | 8/2010 | Dua et al. | 36/50.1 |
| 8,266,749 | B2 * | 9/2012 | Dua et al. | 12/146 C |
| 8,490,299 | B2 * | 7/2013 | Dua et al. | 36/50.1 |
| 8,621,891 | B2 * | 1/2014 | Dua et al. | 66/177 |
| 2010/0154256 | A1 * | 6/2010 | Dua | 36/25 R |
| 2010/0325918 | A1 * | 12/2010 | Johnson | 36/102 |
| 2012/0255201 | A1 | 10/2012 | Little | |

* cited by examiner

*Primary Examiner* — Khoa Huynh
*Assistant Examiner* — Sharon M Prange
(74) *Attorney, Agent, or Firm* — George P. White

(57) ABSTRACT

A shoe upper structure includes an upper layer and a lower layer. The upper layer includes a slot and a plurality of shoe-lace holes. The upper layer further includes a plurality of blocks having patterns thereon. The lower layer is engaged with an inner surface of the upper layer and can be connected with a shoe sole. Front ends of the lower and upper layers are associated to form a front closing edge, and rear ends of the lower and upper layers are associated to form a rear closing edge. Two sides of the lower layer are spaced from two sides of the upper layer. The upper layer can be stretched up, and a rear section of the slot can form a heel opening. The upper and lower layers and the front and rear closing edges are integrally formed with elastomeric yarns by a warp knitting machine.

3 Claims, 4 Drawing Sheets

SHOE UPPER STRUCTURE

BACKGROUND OF THE INVENTION

1. Field of the Invention

The present invention relates to a shoe upper structure and, more particularly, to an integrated shoe upper structure formed by a warp knitting machine.

2. Description of the Related Art

Generally, a sports shoe includes a shoe sole and a shoe upper structure connected with the shoe sole. A conventional shoe upper structure is composed of a top piece, a bottom piece, an inner edge piece, an outer edge piece, and two side pieces. However, the manufacturing process of the conventional shoe upper structure has lots of steps, resulting in material waste and manufacturing costs increase. Furthermore, in order to enhance the wearing comfort of the shoe upper and/or to allow the pieces of the shoe upper to have different flexibility, a plurality of elastic blocks with patterns is usually provided on the top piece of the shoe upper. However, the plurality of blocks associated on the top piece of the shoe upper need to be formed with different piece materials, which is inconvenient in processing and wastes lots of materials, resulting in high cost and low style changes.

BRIEF SUMMARY OF THE INVENTION

Thus, an objective of the present invention is to provide a shoe upper structure to improve the aforementioned problems. The shoe upper structure of the present invention has the advantages of material saving, convenient processing, low manufacturing cost, long service life, and increase of the availability in pattern and style of an outer surface of the shoe upper.

To achieve this and other objectives, a shoe upper according to the present invention includes an upper layer and a lower layer. The upper layer includes front and rear ends spaced along an axis and a slot extending along the axis and located between the front and rear ends of the upper layer. The slot includes a front section adjacent to the front end of the upper layer and a rear section adjacent to the rear end of the upper layer. The upper layer further includes a plurality of shoelace holes in two sides of the front section of the slot. The upper layer further includes opposite outer and inner surfaces. The lower layer is adapted to be associated with a shoe sole and is engaged with the inner surface of the upper layer. The lower layer includes front and rear ends spaced along the axis. The front end of the lower layer is associated with the front end of the upper layer to form a front closing edge, and the rear end of the lower layer is associated with the rear end of the upper layer to form a rear closing edge. Two sides of the lower layer are respectively spaced from two sides of the upper layer, so that the upper layer can be stretched upwards relative to the lower layer. The rear section of the slot forms a heel opening when the upper layer is stretched upwards. The upper and lower layers and the front and rear closing edges are formed with elastomeric yarns into a one-piece integrated construction by a warp knitting machine.

In a preferred form, the upper layer further includes a plurality of blocks with patterns, and each block is integrally formed on the outer surface of the upper layer by the warp knitting machine using the elastomeric yarns.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
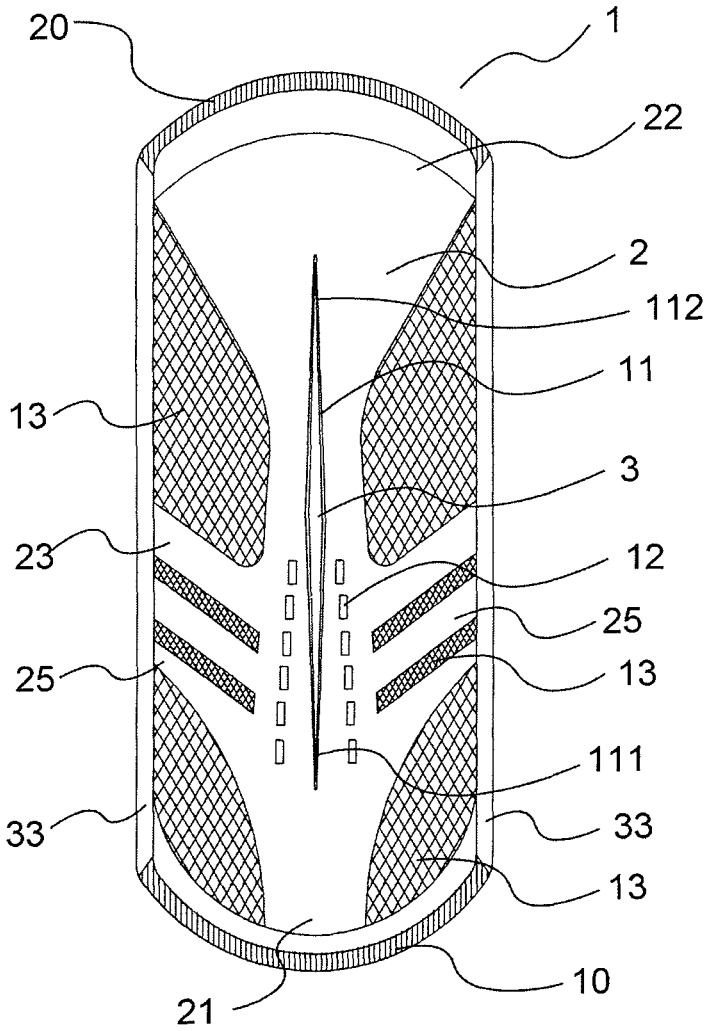
FIG. 1 is a plan view of a shoe upper of the present invention.
Figure 2:
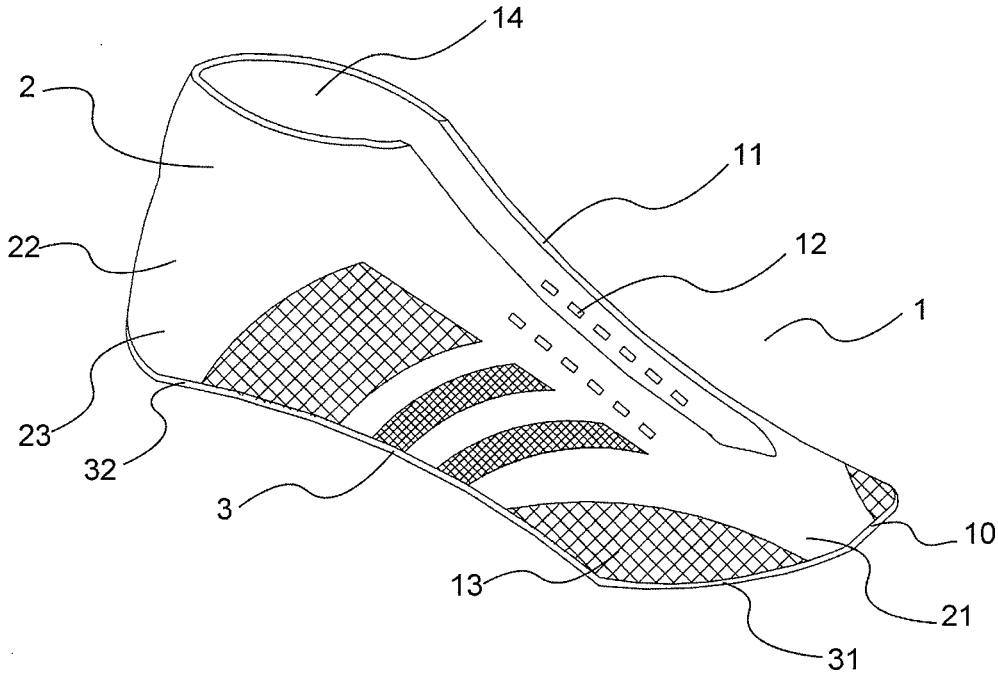
FIG. 2 shows a perspective view of the shoe upper of FIG. 1 with an upper layer of the shoe upper being stretched upwards and opened.
Figure 3:
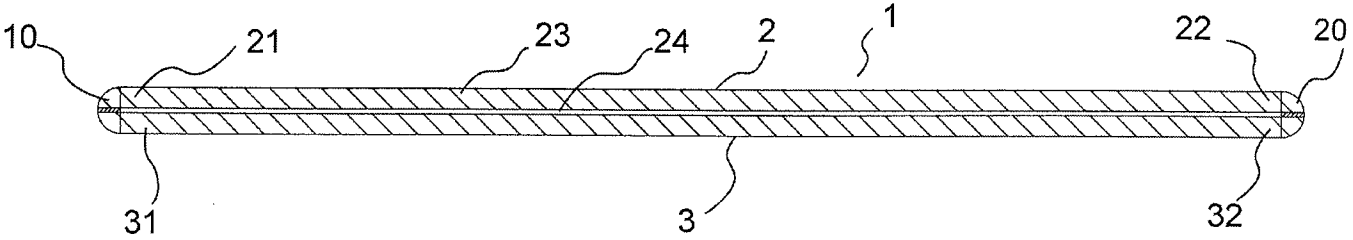
FIG. 3 is a slightly enlarged sectional view of the shoe upper of FIG. 1.

A shoe upper of an embodiment of the present invention is shown in FIGS. 1 through 3 of the drawings and generally designated 1. The shoe upper 1 includes an upper layer 2 and a lower layer 3. The upper layer 2 includes front and rear ends 21 and 22 spaced along an axis, and a slot 11 extends along the axis and is located between the front and rear ends 21 and 22 of the upper layer 2. The slot 11 includes a front section 111 adjacent to the front end 21 of the upper layer 2 and a rear section 112 adjacent to the rear end 22 of the upper layer 2. The upper layer 2 further includes a plurality of shoelace holes 12 provided in two sides of the front section 111 of the slot 11 for a shoelace to extend through and wrap around. Furthermore, the upper layer 2 further includes opposite outer and inner surfaces 23 and 24. The outer surface 23 of the upper layer 2 is provided with a plurality of blocks 13 with patterns.

Figure 4:
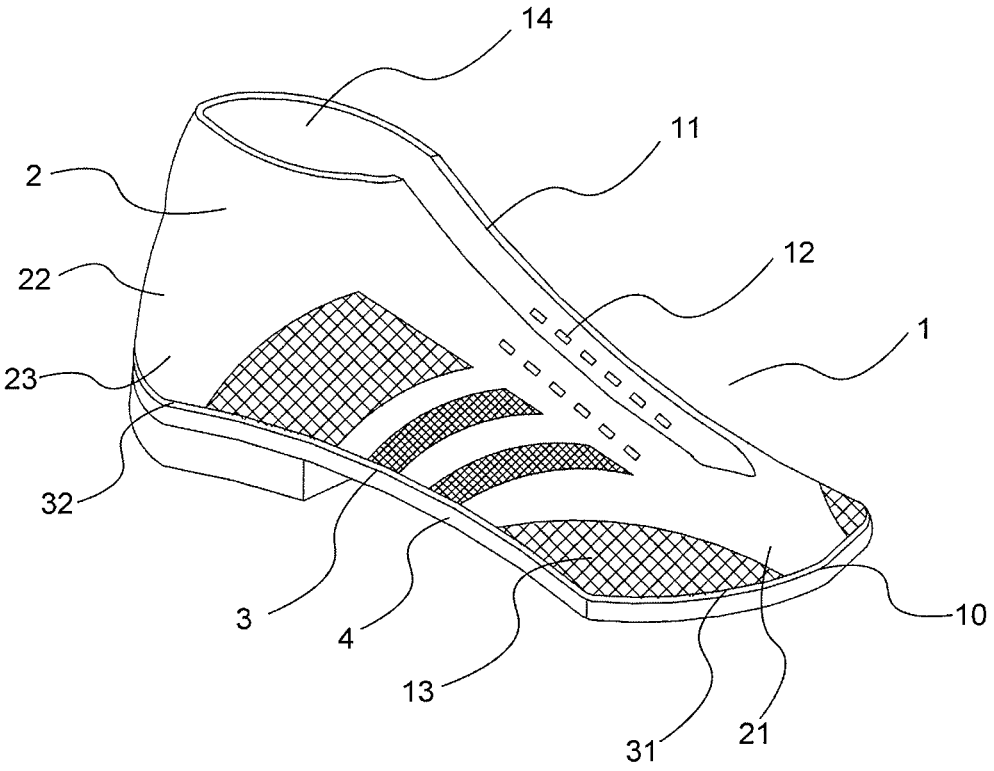
FIG. 4 is a perspective view showing the shoe upper of FIG. 2 associated on a shoe sole.

The lower layer 3 is adapted to be engaged with a shoe sole 4 to form a shoe, such as a sports shoe (see FIG. 4). The lower layer 3 is in the form of a flat surface and is engaged with the inner surface 24 of the upper layer 2. The lower layer 3 includes front and rear ends 31 and 32 spaced along the axis. The front end 31 of the lower layer 3 is associated with the front end 21 of the upper layer 2 to form a front closing edge 10, and the rear end 32 of the lower layer 3 is associated with the rear end 22 of the upper layer 2 to form a rear closing edge 20. Furthermore, two sides 33 of the lower layer 3 are spaced from two sides 25 of the upper layer 2, so that the upper layer 2 can be stretched upwards and opened relative to the lower layer 3 (see FIG. 2). After the upper layer 2 is stretched upwards, the rear section 112 of the slot 11 forms a heel opening 14, so that the upper layer 2 can form a type of athletic shoe-shaped upper structure.

The upper and lower layers 2 and 3, the front and rear closing edges 10 and 20, and the blocks 13 are integrally formed with elastomeric yarns into a one-piece integrated construction by a warp knitting machine. Specifically, in a specific embodiment, a program of the warp knitting machine is firstly used to set up the pattern and style of the shoe upper 1, and, then, elastomeric yarns are used to knit a closing edge (for example, the front closing edge 10). Next, the upper and lower layers 2 and 3 are knitted at the same time. A middle of the upper layer 2 is provided with the slot 11, a plurality of shoelace holes 12 is provided in two sides of the slot 11, and a plurality of blocks 13 with different patterns is knitted on the outer surface 23 of the upper layer 2. When the upper and lower layers 2 and 3 are knitted to a preset length, the rear closing edge 20 is then knitted, completing the production of an integrated shoe upper structure of the invention. The shoe upper structure of the present invention has the advantages of material saving, convenient processing, low manufacturing cost, long service life, and the increase of the availability in pattern and style of the outer surface 23 of the shoe upper 1.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A shoe upper, comprising:

an upper layer that includes front and rear ends spaced along an axis and a slot extending along the axis and located between the front and rear ends of the upper layer, with the slot including a front section adjacent to but spaced from the front end of the upper layer and a rear section adjacent to but spaced from the rear end of the upper layer, with the upper layer further including a plurality of shoelace holes in two sides of the front section of the slot, with the upper layer further including opposite outer and inner surfaces, with the upper layer being of an annular shape including the front and rear ends and the two sides and of a continuous material; and a lower layer adapted to be associated with a shoe sole, with the lower layer engaged with the inner surface of the upper layer and including front and rear ends spaced along the axis, with the front end of the lower layer associated with the front end of the upper layer to form a front closing edge comprising elastomeric yarns, with the rear end of the lower layer associated with the rear end of the upper layer to form a rear closing edge, comprising elastomeric yarns, with the upper and lower layers knit generally planar and abutting; and where two sides of the lower layer are configured, by use of elastomeric yarn at the closing edges, to be spaced from two sides of the upper layer when the upper layer is stretched upwards relative to the lower layer, with the rear section of the slot forming a heel opening when the upper layer is stretched upwards, wherein the upper and lower layers and the front and rear closing edges are together, integrally formed with elastomeric yarns into a one-piece integrated knit construction by a warp knitting machine where the degree of elasticity of the elastomeric yarn at the closing edges is such as to allow the upper layer to be stretched upward from the lower layer to accommodate a foot.

2. The shoe upper according to claim 1, with the upper layer further including a plurality of blocks with patterns, and with each block being integrally formed on the outer surface of the upper layer by the warp knitting machine using the elastomeric yarns.

3. The shoe upper according to claim 1, with the slot terminating at a single point in each of the front and rear sections prior to stretching.

* * * * *